US008099871B2

(12) United States Patent
Bilenski

(10) Patent No.: US 8,099,871 B2
(45) Date of Patent: Jan. 24, 2012

(54) TRANSVERSE ANGULATED UTILITY KNIFE

(76) Inventor: Edward Bilenski, Butler, NJ (US)

( * ) Notice: Subject to any disclaimer, the term of this patent is extended or adjusted under 35 U.S.C. 154(b) by 181 days.

(21) Appl. No.: 12/474,564

(22) Filed: May 29, 2009

(65) Prior Publication Data

US 2009/0241346 A1 Oct. 1, 2009

Related U.S. Application Data

(63) Continuation-in-part of application No. 11/352,728, filed on Feb. 13, 2006, now Pat. No. 7,565,747, which is a continuation-in-part of application No. 10/822,240, filed on Apr. 9, 2004, now abandoned.

(51) Int. Cl.
*B25G 1/00* (2006.01)

(52) U.S. Cl. ..... 30/329; 30/340; 30/342; 30/162

(58) Field of Classification Search ..... 30/162, 30/169, 329, 330, 340, 342, 294; D8/98, D8/99

See application file for complete search history.

(56) References Cited

U.S. PATENT DOCUMENTS

| | | | | |
|---|---|---|---|---|
| 619,131 | A * | 2/1899 | Britt | 30/169 |
| 1,195,297 | A | 8/1916 | Vlchek | |
| 1,317,316 | A | 9/1919 | Reed | |
| 1,327,155 | A | 1/1920 | Gottschalk | |
| 1,493,372 | A | 5/1924 | Moon | |
| 1,704,376 | A | 3/1929 | Teasdale | |
| 1,726,017 | A | 8/1929 | Des Enfants, Sr. | |
| 2,010,744 | A | 8/1935 | Anderson | |
| 2,042,273 | A | 5/1936 | Okun | |
| 2,215,216 | A | 9/1940 | Gits et al. | |
| 2,242,900 | A | 5/1941 | Bender | |
| 2,261,063 | A | 10/1941 | Joyce | |
| 2,267,934 | A | 12/1941 | Lockett | |
| 2,304,332 | A | 12/1942 | Bodkin | |
| D163,562 | S | 6/1951 | Bjork | |
| 2,674,005 | A | 4/1954 | Simon | |
| 2,679,100 | A | 5/1954 | Ehler | |

(Continued)

FOREIGN PATENT DOCUMENTS

WO 2007095130 A2 8/2007

OTHER PUBLICATIONS

International Preliminary Report on Patentability, International Preliminary Examining Authority, Feb. 19, 2009, 6pgs.

(Continued)

*Primary Examiner* — Jason Daniel Prone

(74) *Attorney, Agent, or Firm* — The Marbury Law Group PLLC

(57) ABSTRACT

A utility knife is useful for operations such as glazing, roofing, carpeting and SHEETROCK™ drywall fabrication wherein the knife is used in close proximity to window edges, walls or corners. A blade-holding portion of the utility knife has a planar bottom wall and structure for mounting the blade at a small angle relative to the bottom wall so that the blade is able to flex and substantially conform to the plane of a surface upon which the planar bottom surface of the utility knife is supported. A handle portion of the utility knife is offset from the planar bottom surface so as to position a user's hand away from the surface on which the utility knife is supported.

20 Claims, 11 Drawing Sheets

U.S. PATENT DOCUMENTS

| | | | | |
|---|---|---|---|---|
| D176,537 | S | 1/1956 | Kromsten | |
| 2,784,489 | A | 3/1957 | Reise | |
| 2,788,574 | A | 4/1957 | Marcmann | |
| D196,709 | S | 10/1963 | Johnson | |
| 3,107,426 | A | 10/1963 | Robinson, Jr. | |
| 3,324,548 | A | 6/1967 | Mascia | |
| 3,380,159 | A | 4/1968 | Winston | |
| 3,604,113 | A | 9/1971 | Cuscovitch | |
| 3,626,592 | A | 12/1971 | La Cas et al. | |
| 3,724,010 | A | 4/1973 | Scholl | |
| 3,845,554 | A | 11/1974 | Joanis et al. | |
| D235,414 | S * | 6/1975 | Miller | D8/98 |
| 3,906,625 | A | 9/1975 | Gringer | |
| 3,927,473 | A | 12/1975 | Braginetz | |
| 3,965,575 | A | 6/1976 | Stunger | |
| 3,991,467 | A * | 11/1976 | Yokoyama | D8/98 |
| 4,041,605 | A | 8/1977 | Selfridge | |
| 4,068,375 | A | 1/1978 | Rathbun et al. | |
| 4,109,380 | A | 8/1978 | Anderson | |
| 4,137,631 | A | 2/1979 | Pickett et al. | |
| 4,172,321 | A | 10/1979 | Greenberg | |
| D258,488 | S | 3/1981 | Juziuk | |
| 4,542,554 | A | 9/1985 | Wallerstein | |
| 4,575,940 | A | 3/1986 | Wenzel | |
| 4,617,736 | A | 10/1986 | McCrary | |
| 4,713,884 | A | 12/1987 | Dunnagan | |
| 4,821,418 | A | 4/1989 | Windhager | |
| 4,884,342 | A | 12/1989 | McNamara et al. | |
| 4,890,351 | A | 1/1990 | Wilson | |
| 4,967,476 | A | 11/1990 | Mozeliak | |
| 5,014,429 | A | 5/1991 | McNamara | |
| 5,107,593 | A | 4/1992 | Hutchins | |
| 5,174,028 | A | 12/1992 | Seltzer | |
| 5,208,984 | A | 5/1993 | Negus | |
| 5,241,750 | A | 9/1993 | Chomiak | |
| 5,400,512 | A | 3/1995 | Brush | |
| 5,490,331 | A | 2/1996 | Gold | |
| 5,561,906 | A | 10/1996 | Desmarais | |
| 5,720,105 | A | 2/1998 | Gates | |
| 5,890,294 | A | 4/1999 | Keklak et al. | |
| 5,906,049 | A | 5/1999 | Butts | |
| 5,940,970 | A | 8/1999 | D'Ambro, Sr. et al. | |
| 6,000,137 | A | 12/1999 | Gamba | |
| 6,192,589 | B1 | 2/2001 | Martone et al. | |
| 6,253,454 | B1 | 7/2001 | Gietzen | |
| 6,321,455 | B1 | 11/2001 | Burchell | |
| 6,324,762 | B1 | 12/2001 | Huang | |
| 6,453,563 | B1 | 9/2002 | Farland | |
| 6,629,330 | B2 | 10/2003 | Schultheis et al. | |
| 6,745,478 | B2 | 6/2004 | DeLillo | |
| 6,848,185 | B2 | 2/2005 | Tebo | |
| 6,895,674 | B2 | 5/2005 | Ai | |
| 6,957,491 | B2 * | 10/2005 | Van Deursen et al. | 30/162 |
| 6,966,113 | B2 * | 11/2005 | Fossella | 30/162 |
| 7,100,285 | B1 * | 9/2006 | Huang | 30/162 |
| 7,565,747 | B2 * | 7/2009 | Cobb et al. | 30/329 |
| D645,721 | S * | 9/2011 | Wu | D8/99 |
| 2003/0110641 | A1 | 6/2003 | Gringer | |
| 2004/0000055 | A1 | 1/2004 | Lee Fan | |
| 2004/0158992 | A1 * | 8/2004 | Huang | 30/162 |
| 2005/0223567 | A1 | 10/2005 | Cobb et al. | |
| 2006/0123637 | A1 | 6/2006 | Cobb et al. | |
| 2011/0271531 | A1 * | 11/2011 | Huang | 30/162 |

OTHER PUBLICATIONS

International Preliminary Report on Patentability, International Preliminary Examining Authority, Mar. 9, 2009, 5pgs.

* cited by examiner

TRANSVERSE ANGULATED UTILITY KNIFE

RELATED APPLICATIONS

This application is a continuation-in-part of application Ser. No. 11/352,728 filed Feb. 13, 2006, now U.S. Pat. No. 7,565,747, which is a continuation-in-part of application Ser. No. 10/822,240, filed Apr. 9, 2004, now abandoned, both of which are hereby incorporated by reference.

BACKGROUND

Various prior art utility knives place the knife blade in-line with the handle and minimize protrusion of the knife to reduce blade breakage. Any angulation suggested is within the plane formed by the handle and the plane of the knife. This arrangement of the knife components fails to solve a troublesome problem encountered by glaziers and SHEETROCKT™ drywall workers, namely the need to make perpendicular cuts in tight corners. Such cuts require long blade lengths and close placement of a worker's hand in tight corners increasing the risk of injury. An in-line placement of blade and handle prevents a close approach of the knife to the wall edge or base due to the size of the worker's hand and in-line location of the blade.

SUMMARY

Disclosed embodiments provide a utility knife having a transverse angulation feature that enables carpet cutting, glue scraping, roof work, glazing and sheet rock operations to proceed in a safe, efficient and reliable manner. A blade-holding portion of the utility knife has a planar bottom wall and structure for mounting the blade at a small angle relative to the bottom wall so that the blade is able to flex and substantially conform to the plane of a surface upon which the planar bottom surface of the utility knife is supported. A handle portion of the utility knife is offset from the planar bottom surface so as to position a user's hand away from the surface on which the utility knife is supported. In certain embodiments, a utility knife has a multi-edged blade and a two-piece construction comprising a bottom section and a top section. A reversible multi-edged detachable blade with an anchoring hole may be mounted on a locating lug attached firmly to the bottom section or top section. The locating lug locates the blade and prevents forward or reverse motion. The blade is held firmly between the bottom and top sections within a channel by clamping the sections together and fixing them in the clamped condition using a toe-in-shoe attachment at the blade end of the handle and a fastening means, such as a machine screw, a countersunk hole and threaded tap-hole at location on the handle displaced from the toe-in-shoe attachment. The clamping section of the handle locates the blade firmly at a slight angle between about 2° and 10°, preferably at about 5°, to the horizontal plane defined by the planar bottom surface of the bottom section. As use herein, a "planar bottom surface" need not be a continuous flat surface and may contain channels, concavities and the like, so long as it provides a support surface for the utility knife that aligns the knife with a planar surface upon which it is used.

In one embodiment, the channel in the bottom section firmly captures the multi-edged blade between edges of the channel and locates the blade in the desired plane. The channel is angled at a slight angle between about 2° and 10°, preferably at about 5°, from a horizontal plane defined by a planar bottom surface of the bottom section. This rigid attachment grips the blade firmly (by the compression caused by machine screw or screws in combination with the toe-in-shoe attachment) within the channel located by the locating pin and allows longer protrusion of the blade to allow desirable flexing of the blade to meet the needs of glaziers, roofing contractors, carpet installers and SHEETROCKT™ drywall workers. The bottom section may include a hollow portion providing a storage compartment in the bottom section for holding one or more blades.

Each of the blades may have symmetrical geometrical structures with two or more cutting edges, and preferably at least four cutting edges and two or more sharp corners. The multi-edged blade may be reversible end-to-end and side-to-side to provide a fresh cutting edge. The multi-sided blade may be replaced with a new blade from the optional storage compartment within the bottom section of the handle. If the utility knife is exclusively used for left-handed or right-handed use, the blade may be turned upside down to provide a fresh unused sharp edge. The blade may have two holes, which match with the locating pin. The multi-edge blade is suited for use as a utility knife for left-handed or right-handed cutting without any blade adjustment.

As a consequence of the transverse angulation of its blade and offset handle, the utility knife is especially convenient for use in window glazing applications, roof cutting or carpet cutting, since the hand is not located in-line with the blade. The transverse angulation of the blade may be in the range of about 2° to 10° and preferably about 5°. The offset handle may also be transversly angulated in the range of about 100° to 170° and more preferably between about 135° to 150°. The knife may not be angled for making cuts in tight corners and cuts, which is essentially perpendicular to the surface can be easily made since the size of the hand is accommodated by the offset and/or transverse angulation of the handle. The utility knife can be used in right angle applications such as scoring of linoleum or SHEETROCKT™drywall in tight places, such as corners and the like. Previous utility knives have been stubby and straight. These prior art configurations prevented facile operation of the knife, owing, in part, to interference from the operator's hands.

The various disclosed embodiments of a multi-edged utility knife are designed to address a common system for window glazing that comprises use of a frame having a right-angled open channel to accommodate a glass pane. The glazing may be accomplished by placing a bed of putty or similar glazing compound along the inside vertex of the channel and then inserting a pane of glass into the bedding compound. The pane is pressed to extrude any excess putty and assure complete coverage of the edge and a fully hermetic seal. The pane may then be secured with glazing points or similar fasteners.

This system is intended to allow replacement of broken glass in a simple manner. However, extraction of the old pane frequently requires use of a sharp knife or similar flat cutting instrument to break the putty seal between the flat surface of the glass near its edges and the sides of the right-angled frame generally parallel thereto, requiring a perpendicular cut. Conventional straight utility knifes, putty knives, or razor blades are often used for this task but have proven to be poorly suited and, in some cases, even hazardous to the artisan. With each of these tools, the user's hand gripping the handle prevents the blade from being aligned with the perpendicular plane of the gap between the window and the frame. The user may attempt by downward pressure against the glass to bend the blade to align and insert it in the gap for cutting. However, the bending and pressure entail significant risk of injury, as the generally brittle blade may snap and project sharp fragments or the glass may fracture and expose the user's hand to laceration. In marked contrast, the transverse angulation of the present blade and offset handle that provides a stable knife support obviates these difficulties. Inadvertent breakage of blades is reduced or eliminated. Disclosed embodiments of the utility knife allows making cuts, which are essentially perpendicular to the surface easily, a feature unavailable in knifes where the handle is in-line with the knife blade. The force applied by the user against the glass is significantly lower than that heretofore required to bend the blade of prior art glazing knives. This, in turn, greatly reduces the risk of injury to the artisan from broken glass or blades. Disclosed embodiments of the utility knife are also far less likely to nick or otherwise damage the window frame.

DETAILED DESCRIPTION

As used herein, the term "multi-edged blade" refers to a thin, flat blade formed of suitably strong metal or the like that has between 2 and 6 edges that have been sharpened for cutting purposes. The term "multi-edged utility knife" refers to disclosed embodiments of a utility knife that is capable of making perpendicular cuts to surfaces which are in close proximity that would ordinarily prevent conventional in-line knifes being used due to their stubby construction as well as inability of hand which grips the handle to approach the region to be cut with the blade in a vertical position. The multi-edged utility knife also has the ability to expose a fresh unused edge by reversing the blade side-to-side or left-to-right or use a new blade from the holding compartment. Since the multi-edged knife blade is omnidextrous it may be used conveniently for left-handed or right-handed use. The multi-edged blades preferably have two holes which mate with a locating pin or lug when the blade is rotated by 180 degrees. In a preferred embodiment, the multi-edged utility knife has top and bottom sections which holds the blade in a clamping section including a locating pin or lug on the top or bottom section. The two sections are securely held together using one or two machine screws on one end and a toe-in-shoe attachment at the other end of the utility knife. The knife blade sits in a channel formed in the blade-holding portion of the bottom section so that it does not move. The blade is entirely locked in position within the blade-holding portion and its position is not maintained by friction. The term "transversely angulated" means that the knife blade is nominally angled slightly with respect to a bottom surface of the knife. The handle portion of the utility knife can also be transversely angulated or offset relative to the bottom surface of the utility knife to provide clearance for a user's hand.

Figure 1A:
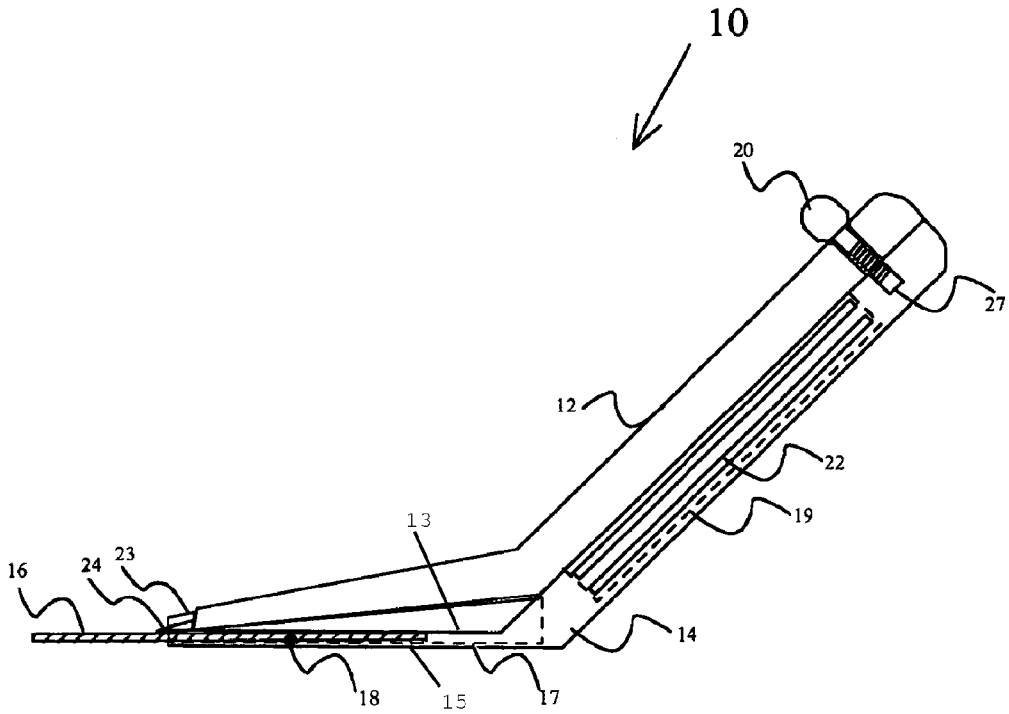
FIG. 1*a* illustrates a side sectional view of a multi-edged utility knife at 10, which accepts a variety of multi-edged blades suited for various applications including carpet installers, roofers and glaziers in the as supplied condition, showing the front view and top view of the transversely angulated knife.
Figure 1B:
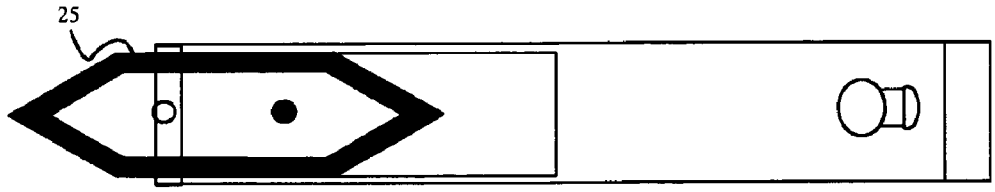
FIG. 1*b* illustrates a top view of multi-edged utility knife of FIG. 1*a;*

Referring to FIG. 1*a* there is shown a side sectional view and directly below it in FIG. 1*b* a top sectional view of an embodiment of a utility knife for wallboard use in 10. It shows an extended knife blade element at 16, where it protrudes less than 50% of its length and is held by the top section 12 and the bottom section 14. The top section 12 is shown as a transparent body in FIG. 1*b* to illustrate the details of placement of the multi-edged wallboard blade 16. The knife blade element 16 is held tightly between the top and bottom sections 12 and 14 by the clamping force of a bolt 20 that passes through top section 12 and is threaded into a hole at 27 in the bottom section 14. The clamping method may be other than use of a bolt as indicated in the drawing. One of the holes in the knife blade element 16 mates with a pin or lug protrusion 18 in the bottom section 14, and the knife blade element rests in a channel 17 in the bottom section 14. Alternatively, the pin may be attached to the top section or may be located in holes drilled in the top and bottom sections. Although not shown at an angle, the channel 17 and blade clamping surface 13 are angled at a slight angle between about 2° and 10°, preferably at about 5°, from a horizontal plane defined by a planar bottom surface 15 of the bottom section 14. The tip 24 at the end of blade clamping surface 13 on the left side member 12 slides inside a shoe like protrusion in the right side member at 23 so as to hold blade 16 in a lower, off-center position angled slightly with respect to the planar bottom surface 15. The knife blade is easily removed by loosening the bolts 20, and separating the top and bottom sections 12 and 14. The bottom section 14 preferably has a cavity at 19 to hold extra knife blades 22. Since the multi-edged blade element 16 is symmetrical, it may be used in a left-handed or right-handed configuration without any modification to the multi-edged blade.

Figure 2A:
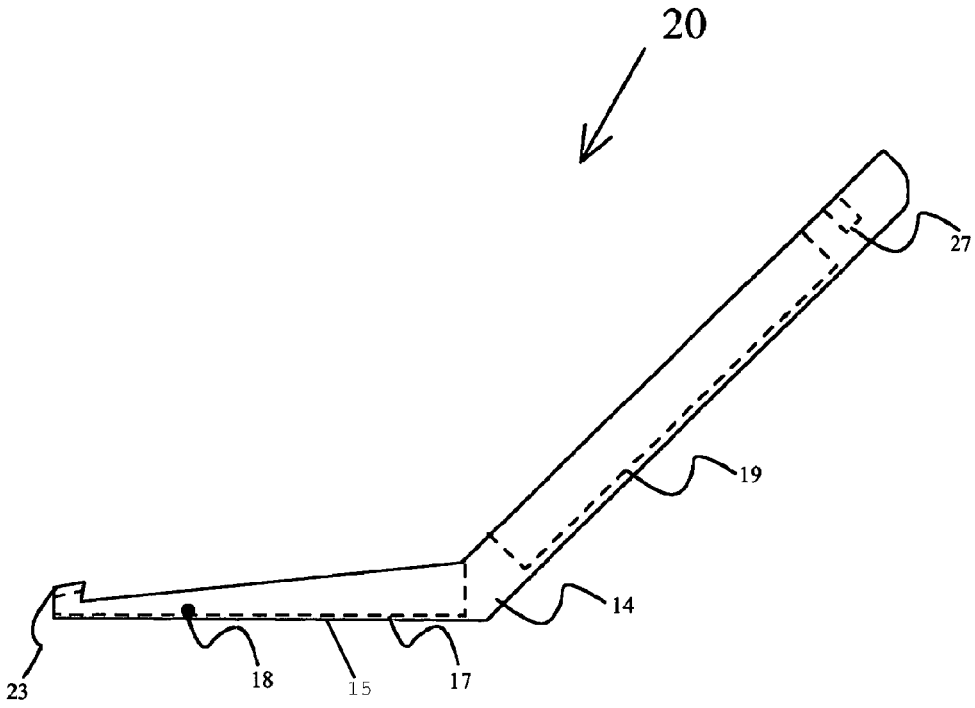
FIG. 2*a* illustrates a side view of the details of bottom section 14.
Figure 2B:
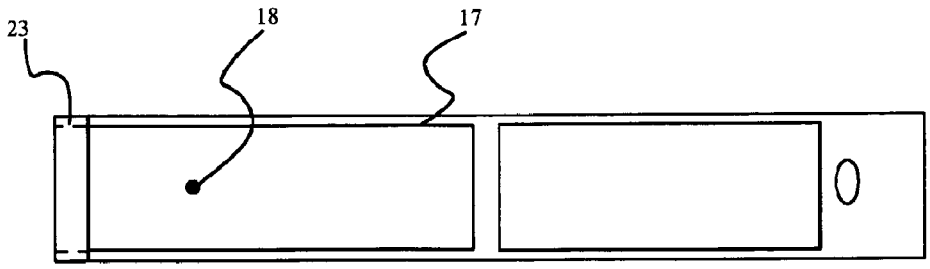
FIG. 2*b* illustrates a top view of the details of bottom section 14 of FIG. 2*a;*

Structural details of an embodiment of a multi-edged utility knife are shown in FIGS. 2*a*, 2*b*, 3*a* and 3*b*. In FIG. 2*a* there is shown a side view detailing bottom section 14. Directly below, in FIG. 2*b*, a top view of the bottom section 14 is depicted. A channel 17 is formed adjacent planar bottom surface 15 in the blade-supporting portion to accept the knife blade. The width of the channel is substantially the same as the width of the blade, which is designed to fit as a loose fit. The depth of the channel 17 combines with the clamping surface 13 to form a space that is slightly less than that of the blade thickness so that when the top and bottom sections 12 and 14 are clamped, the knife blade 16 is firmly held. Also illustrated is an opening which houses spare knife blades at 19. The bottom section carries the locating pin or lug protrusion 18 within the channel 17, as shown to receive the hole in a blade element. It has a threaded hole at 27 to accept the bolt 20, which accomplishes the clamping action of the top and bottom sections. Bottom section 14 has a shoe-like protrusion at 23 to accept the tip 24 of the top section. The threaded portion of the bolt is only as deep as that of the bottom section and the bolt fits as a sliding fit into the top section. Thus, the shoe 23 and tip 24 firmly hold the knife blade element in between the top and bottom sections even when force is applied to the knife blade.

Figure 3A:
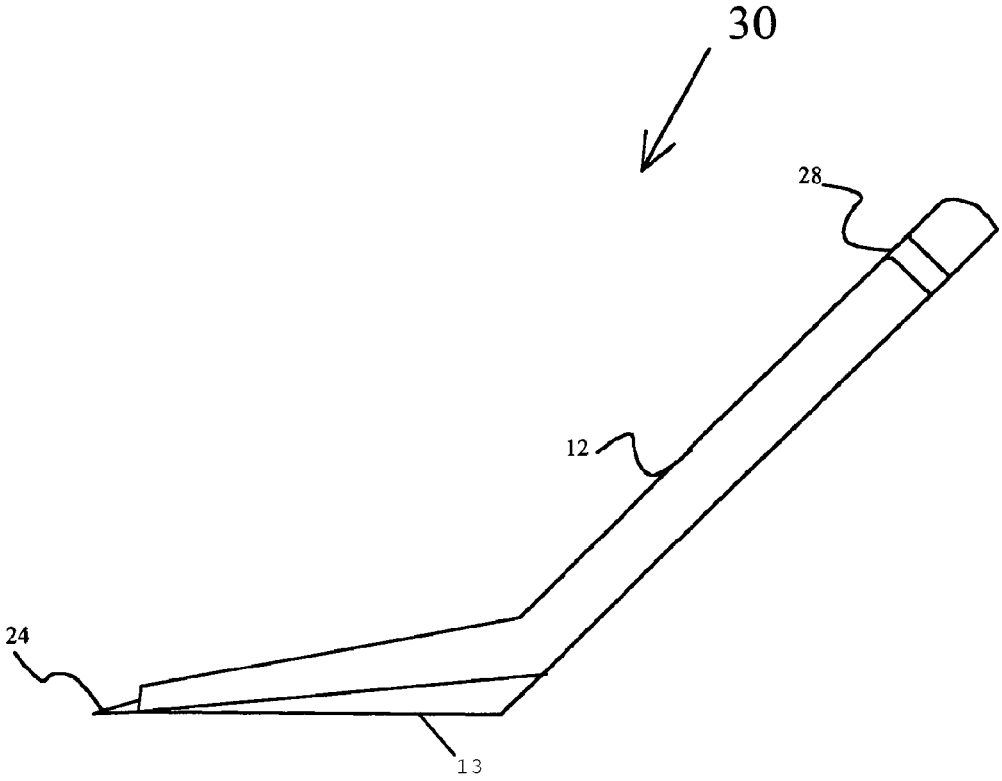
FIG. 3*a* illustrates a side view of the details of the top section 12.
Figure 3B:
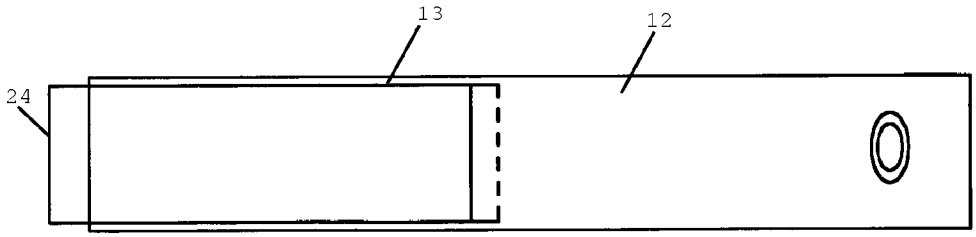
FIG. 3*b* illustrates a top view of the details of top section 12 of FIG. 3*a;*

FIG. 3*a* illustrates the details of the side view of top section 12 and its top view is shown in FIG. 3*b*. The tip 24 of clamping surface 13 on top section 12 is designed to slide into shoe 23 of the bottom section and capture the knife blade element 16. The hole at 28 is a clearance hole for the bolt 20.

Figure 4:
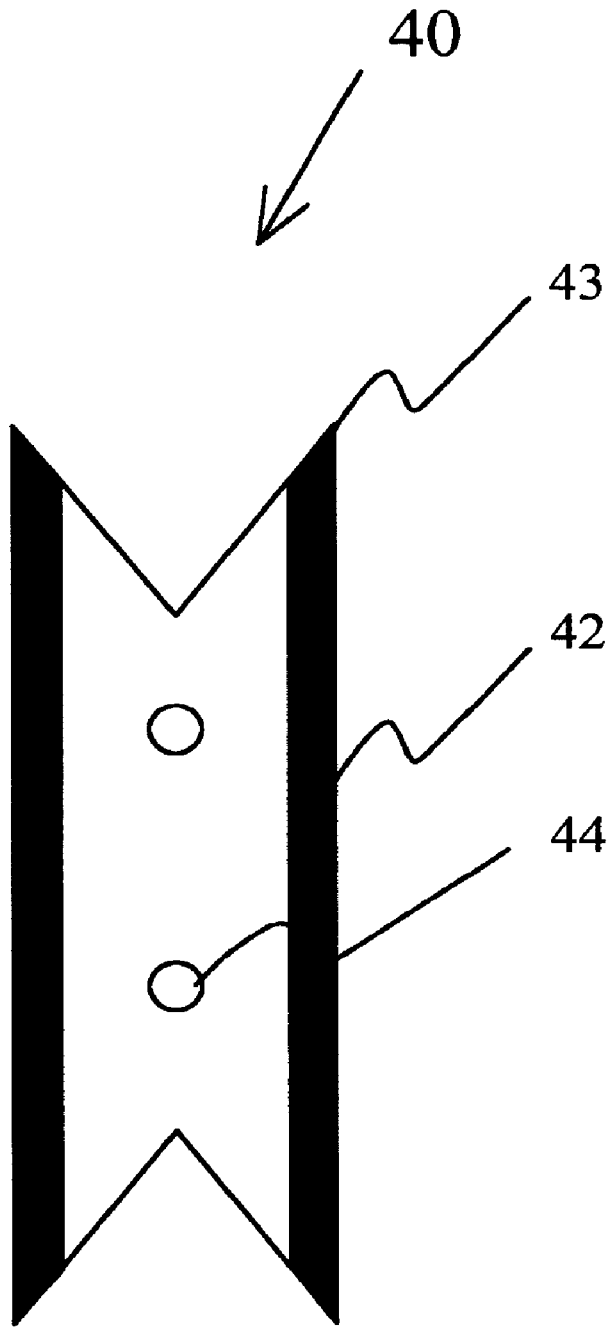
FIG. 4 illustrates a corner utility blade knife element 16 in a configuration as a wallboard blade.

Referring to FIG. 4, the detail of the multi-edged knife blade element 16 of FIG. 1 configured as a wallboard blade is shown at 40. The multi-edged wallboard blade has two sharp edges at 42 and two locating holes at 44. The multi-edge wallboard blade has four sharp corners suited for scoring wallboards at 43. This multi-edged wallboard blade may be used in the forward direction or reversed direction for left-handed or right-handed operation.

Figure 5:
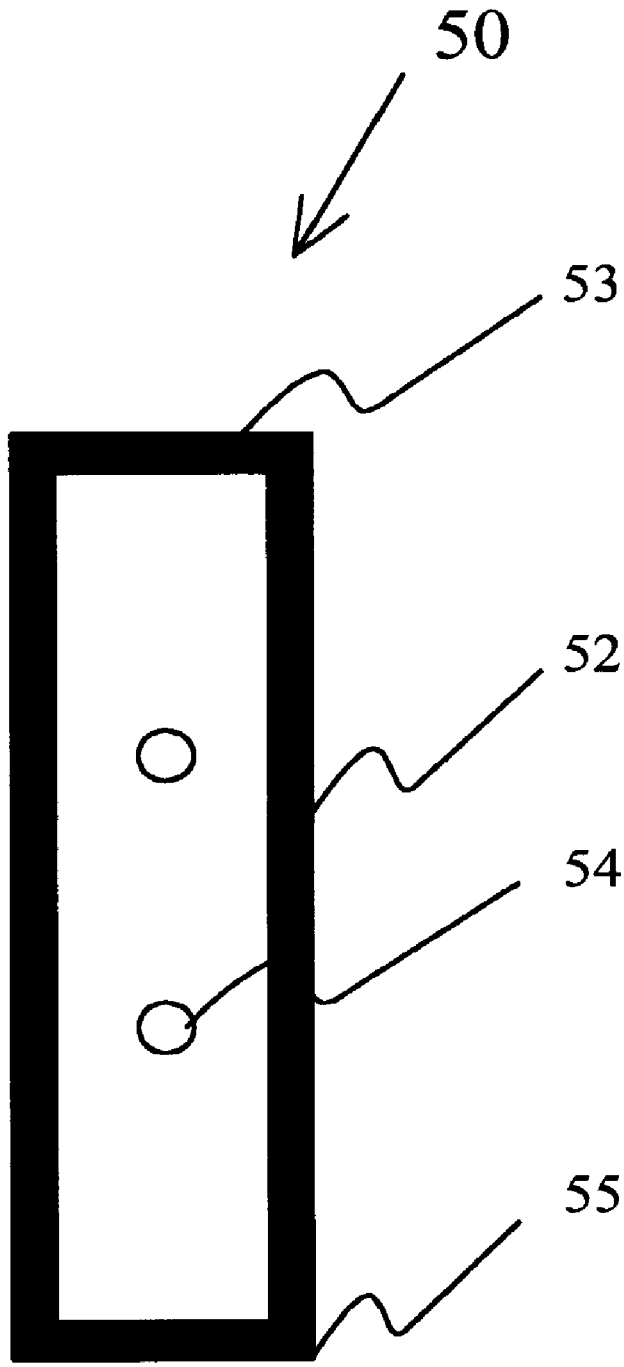
FIG. 5 illustrates a corner utility blade knife element 16 in a configuration as a combination carpet/scraper blade.

Referring to FIG. 5, there is shown further structural details concerning the multi-edged knife blade element 16 of FIG. 1. As illustrated by FIG. 5, the multi-edged knife blade is configured as a combination carpet/scraper blade, shown generally at 50. The multi-edged carpet/scraper blade has a sharp edges at 52 and two locating holes at 54. The multi-edge carpet/scraper blade has four sharp corners suited for scoring carpets at 55. The sharp edge at 53 is used for scraping carpet glue. This multi-edged carpet/scraper blade may be used in the forward direction or reversed direction for left-handed or right-handed use.

Figure 6:
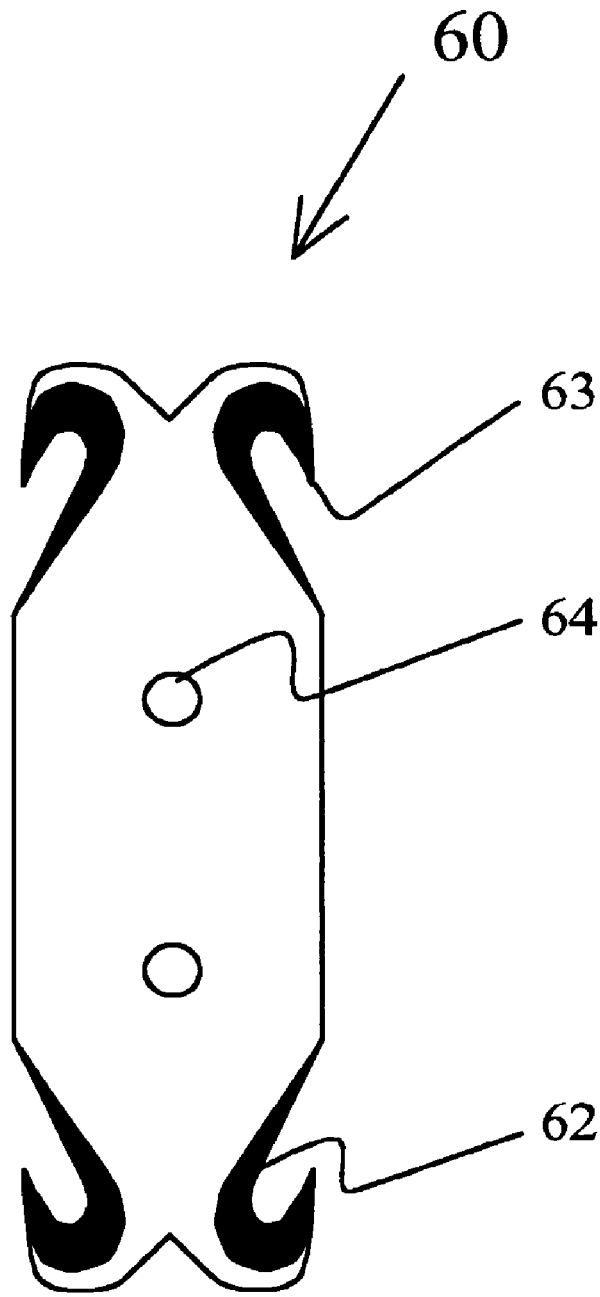
FIG. 6 illustrates a corner utility blade knife element 16 for a roofing blade configuration.

Referring to FIG. 6, the detail of the multi-edged knife blade element 16 of FIG. 1 configured as a roofing blade is shown at 60. The multi-edged roofing blade has sharp hook like corners 63, with sharp cutting edges 62 and two locating holes 64. This multi-edged roofing blade may be used in the forward direction only for left-handed or right-handed operation.

Figure 7:
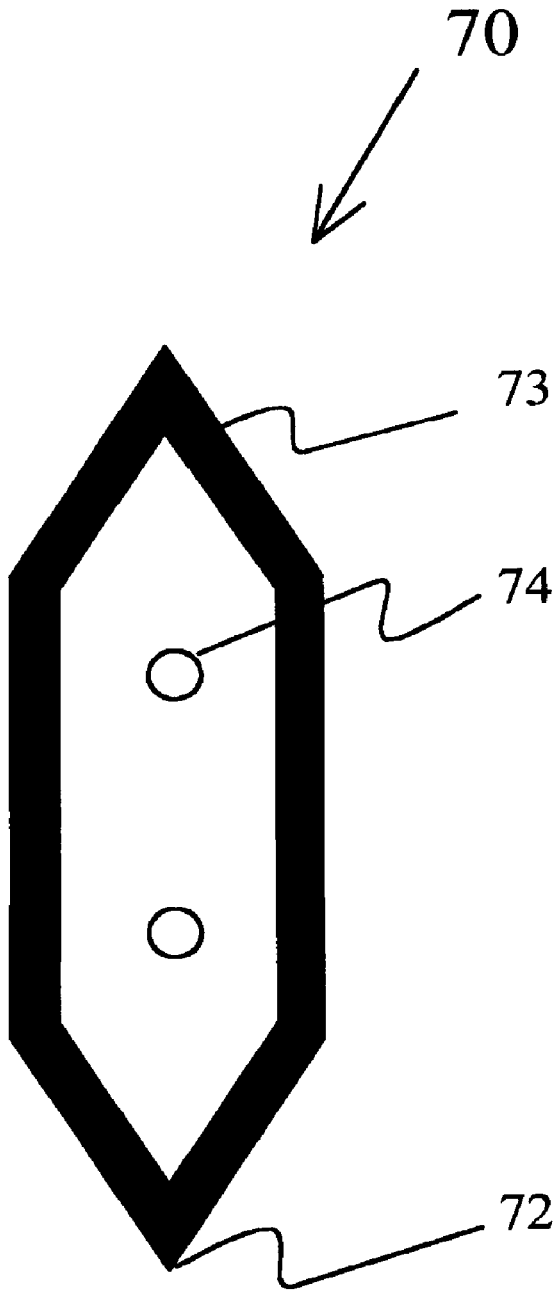
FIG. 7 illustrates a corner utility blade knife element 16 for a glazier blade configuration.

Referring to FIG. 7, the multi-edged knife blade element 16 of FIG. 1 is configured as a glazier blade, shown generally at 70. The multi-edged glazier blade 70 has a sharp edge 73 and two locating holes 74. The multi edge blade has two sharp corners suited for cutting into rubber bead of glass windows at 72. This multi-edged glazier blade may be used in the forward direction or reversed direction for left-handed or right-handed operation.

Figure 8A:
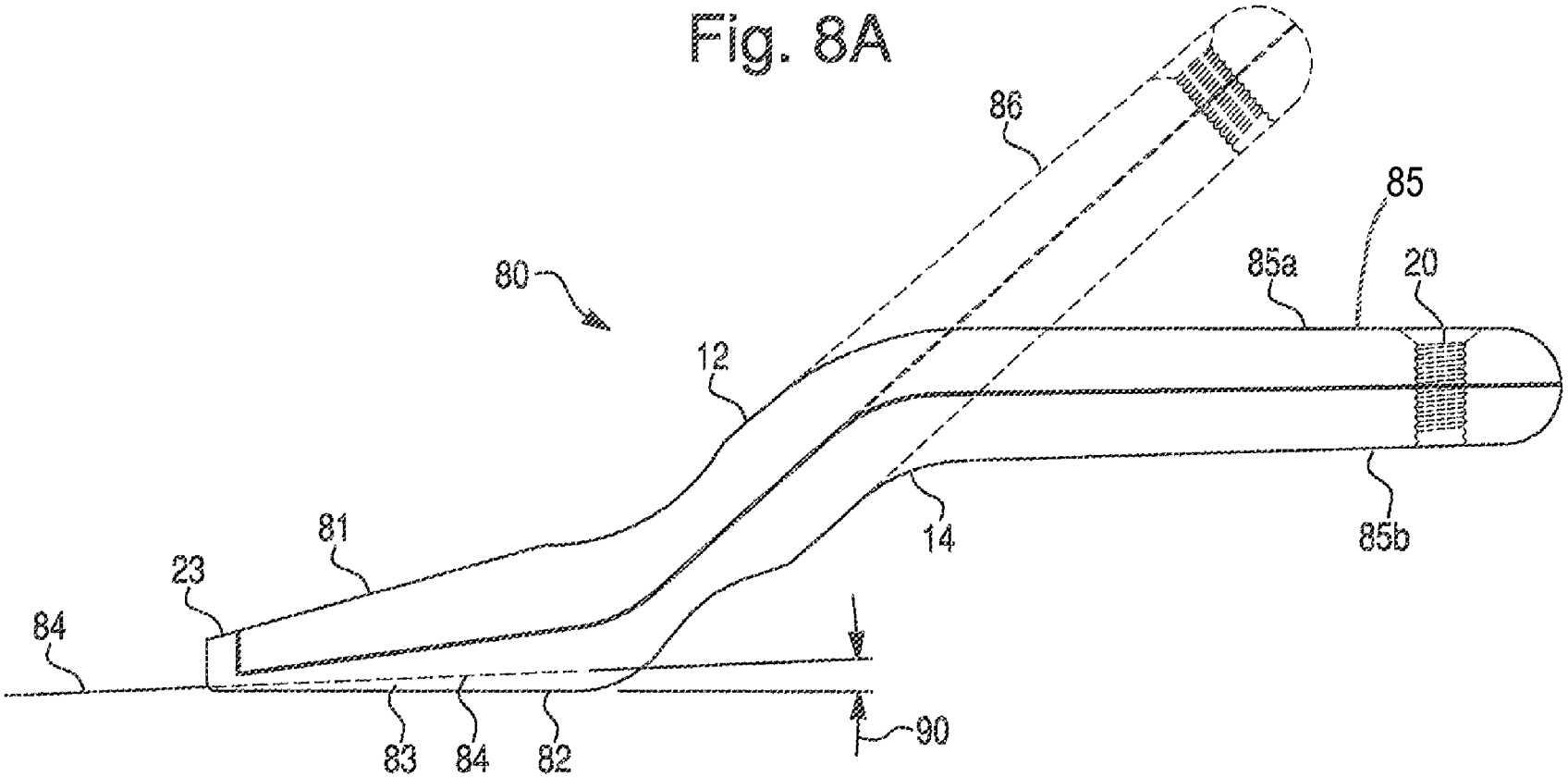
FIG. 8*a* illustrates a side view of an alternate embodiment of an angulated utility knife.

FIG. 8A illustrates a side view of an alternate embodiment of a transversely angulated utility knife 80. In this embodiment, the utility knife comprises a blade-holding portion 81 and an offset handle portion 85. This embodiment includes a top section 12, a bottom section 14, a bolt 20, and a threaded hole 27 (see FIG. 8C), as in the embodiment of Figs. l*a*-3*b*. The blade-holding portion has a planar bottom wall 82 that, in use, is positioned on surfaces substantially perpendicular to the material to be cut. An interior blade-supporting surface 83, such as a planar channel substantially adjacent to the bottom wall 82 and dimensioned for holding a flat blade 84, is configured as a plane at an angle 90 between about 2° and 10° to the plane of the bottom wall 82. The blade-supporting portion 81 further includes a tip portion adjacent to one end of the bottom wall 82 that has a slot-shaped opening or through which a blade 84 extends. The offset handle portion 85 is offset a sufficient distance from the bottom surface 82 so as to allow room for a user's hand. Alternatively, the handle portion may be angulated from the blade-holding portion at an angle to the bottom wall 82 as illustrated in phantom at 86 (and as illustrated in F*ig*. 1). In either form, the offset handle 85 or 86 extends from the blade-holding portion 81 at an end opposite the blade 84. Although illustrated as extending behind the blade 84, the offset handle 85 may also extend above the blade (much like old-fashioned irons) without departing from the invention.

Figure 8B:
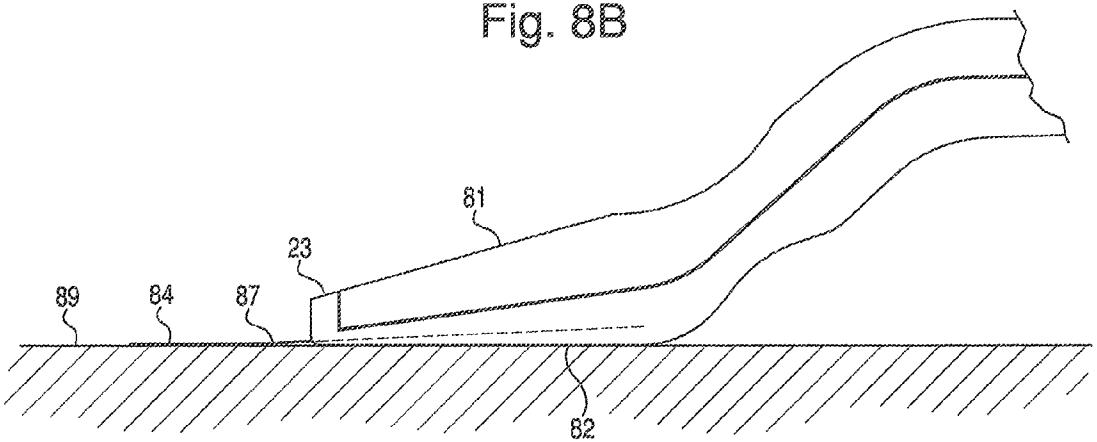
FIG. 8*b* illustrates a side view of a blade-supporting portion with a blade flexing to be substantially parallel to a supporting surface.

FIG. 8B illustrates the blade-holding portion 81 of a utility knife in use adjacent a surface 89. With the planar bottom surface 82 adjacent to the surface 89, the blade 84 can bend at 87 so as to align in a parallel manner with the surface 89. So configured, the bade 84 is positioned to cut items perpendicular to the surface, such as adjacent drywall, linoleum flooring at a corner with a wall, roof shingles adjacent a vertical wall, etc.

FIG. 8B also illustrates how the utility blade configuration positions the blade 84 on the working surface 89 with a smooth bottom surface 82 that will not scratch or mar the surface 89. The blade holding portion 81 includes a toe-in-shoe attachment 23 which works in combination with a threaded fastener 20 at a distal location on the handle 85*a*, 85*b*, 86 to securely clamp the blade 84 against the blade-supporting surface 83. When assembled, a toe portion 24 of the upper blade portion 85*a* slides into a slot or shoe portion 23 in the lower handle portion 85*b* to form a pivot point for clamping the blade against the blade-supporting surface 83. Providing the clamping force with a toe-in-shoe 23 attachment at the blade exit portion of the utility knife enables the blade to be securely clamped to the blade-supporting surface 83 without using a fastener in the blade holding portion 81. This configuration is beneficial because clamping the blade holding portion 81 could cause the bottom wall 82 to have protrusions (e.g., the head or tip of a threaded fastener) which could scratch or gouge the working surface 89.

Figure 8C:
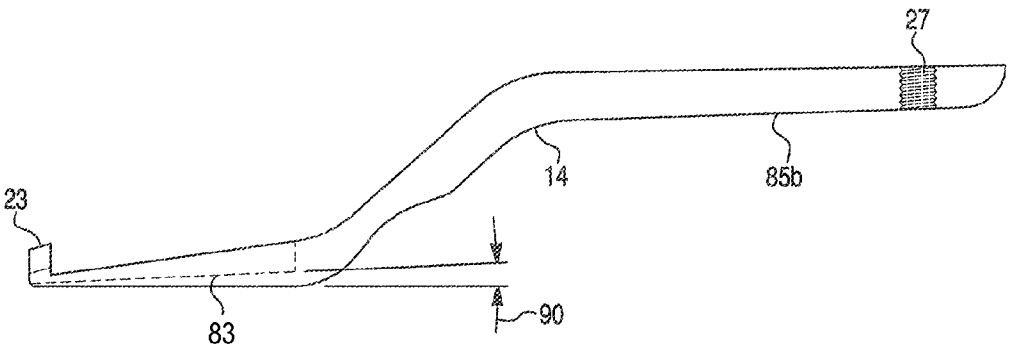
FIG. 8C illustrates a side view of a bottom portion of the utility knife handle.

FIG. 8C shows the bottom portion of the utility knife handle 85*b*. As mentioned above, the bottom portion of the utility knife handle 85*b* includes the shoe portion 23 and an interior blade-supporting surface 83. The interior blade-supporting surface 83 is configured as a plane at an angle 90 between about 2° and 10° to the plane of the bottom wall 82. So configured, a blade 84 in contact with the interior blade-supporting surface 83 will extend from the tip portion (below shoe 23) at a slight angle to the bottom surface.

Figure 8D:
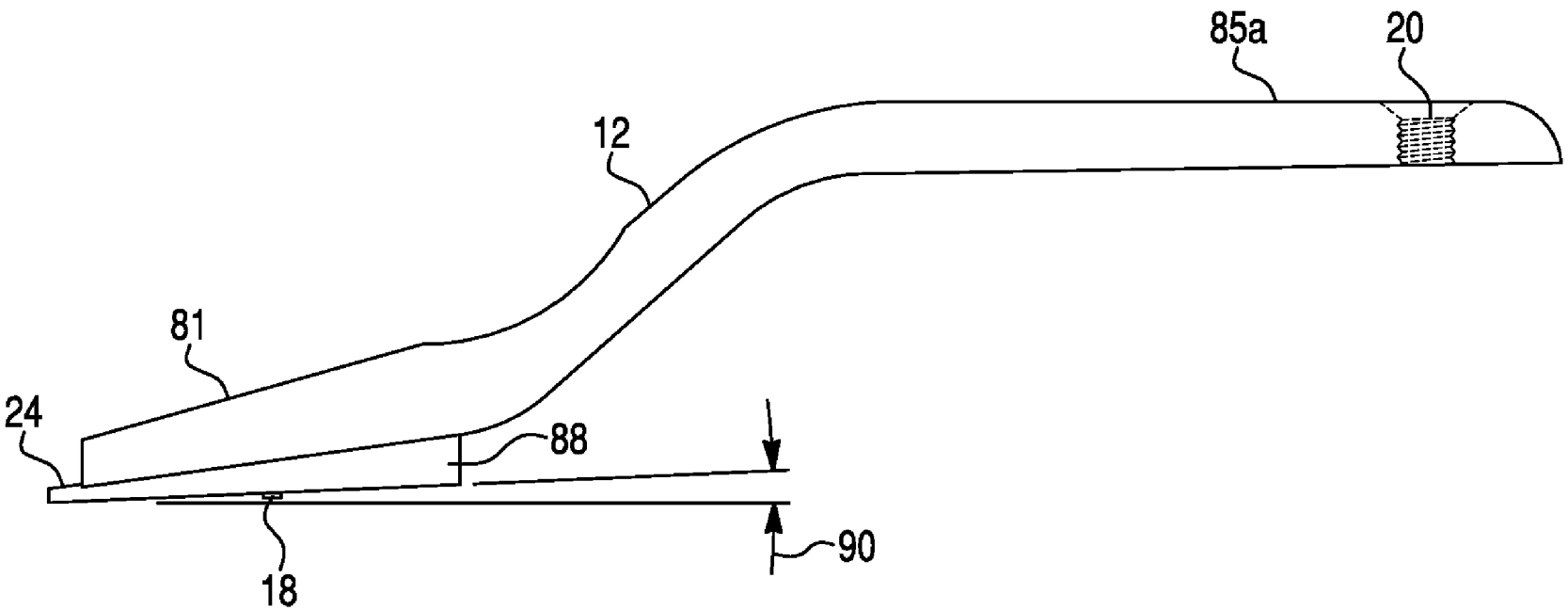
FIG. 8D illustrates a side view of a top portion of the utility knife handle.

FIG. 8D shows the top portion of the utility knife handle 85*a*. As mentioned above, the top portion of the utility knife handle 85*a* includes the toe portion 24 which fits into the shoe portion 23 when assembled to provide a clamping pivot. The utility knife handle 85*a* also includes an interior (when assembled) blade-clamping surface 88. The blade-clamping surface 88 is sized to fit within the planar channel in the bottom portion 85*b* and cooperate with the blade-supporting surface 83 to securely clamp onto the blade 84 in the assembled configuration. The blade-clamping surface 88 is configured so its bottom portion forms an angle 90 with the horizontal of between about 2° and 10°, thereby cooperating with the blade-supporting surface 83 of the bottom portion of the utility knife handle 85*b* to secure the blade 84 at the angle 90 to the bottom surface 82. In the illustrated embodiment, the pin or lug protrusion 18 is positioned in the blade-clamping surface 88 to engage a hole in the blade 84 to prevent sliding when the blade 84 is clamped in the assembled handle 81.

Additional details of the utility knife 80 may be similar to the other embodiments described herein. Similarly, blade 84 may be multi-edged and can have any previously-described form.

Figure 9A:
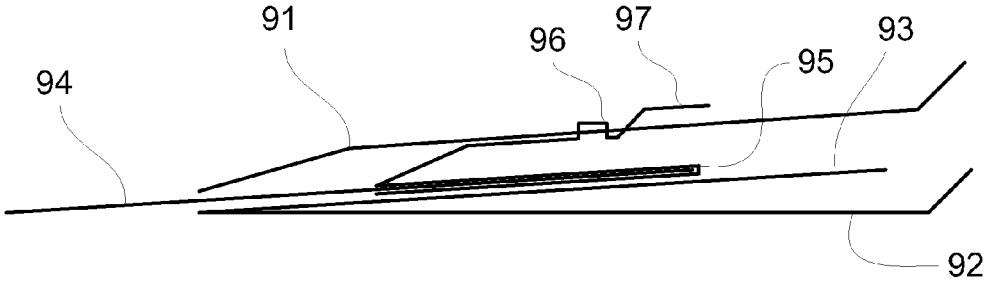
FIG. 9*a* illustrates a side sectional view of a blade supporting portion with a retractable blade carriage.
Figure 9B:
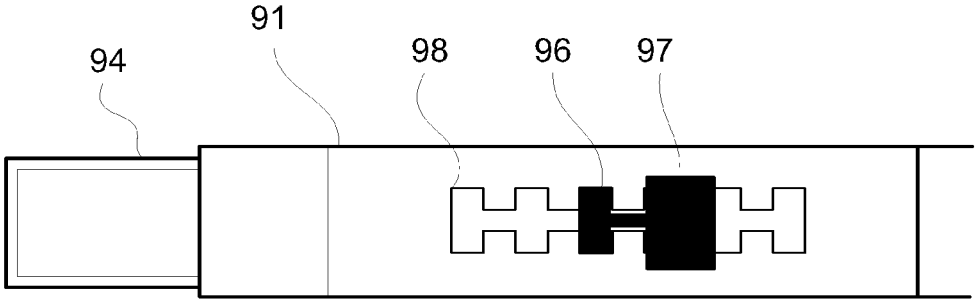
FIG. 9*b* illustrates a top view of a blade supporting portion with a retractable blade carriage.

FIGS. 9A and 9B illustrate another alternate embodiment for a blade-holding portion 91 of a utility knife in which the blade 94 is mounted in a retractable and/or selectively-positionable manner. As illustrated in the sectional side view of FIG. 9A, a blade-holding portion 91 includes a planar bottom surface 92 and a blade-supporting surface 93 that is angled at a slight angle between about 2° and 10°, preferably at about 5°, to the horizontal plane defined by the planar bottom surface 92 of the blade-holding portion 91. The blade 94 is supported in an adjustable/retractable carriage 95 that can be selectively positioned at various positions along the blade-supporting surface 93. The carriage 95 includes a resilient beam with a retainer 96 and an actuator 97. The resilient beam works cooperatively with a retainer slot 98 to secure the carriage 95 in specific locations of blade deployment. As illustrated in FIGS. 9A and 9B, when a user depresses the actuator 96, the retainer 96 drops below the retainer slot 98 and can be moved to another position within the retainer slot 98. When the carriage 95 is repositioned in this manner, the blade 94 is also repositioned. The retainer slot 98 can include multiple openings dimensioned for accepting retainer 96 so that the blade 94 can be extended from the blade-holding portion 91 differing amounts. The retainer slot 98 may further include a continuous portion that allows the actuator 97 to extend through the slot 98. While illustrated in a particular form, numerous other forms of this embodiment are also possible. Examples of similar adjustable/retractable carriage structures that can be employed include those disclosed in U.S. Pat. Nos. 2,548,797, 2,601,723, 4,558,517, 4,955,138, and 5,433,004.

While numerous embodiments have been illustrated, note that the drawings are not necessarily to scale and do not necessarily illustrate correct angular dimensions. Numerous dimensional modifications can be made within the scope of the appended claims.

In a basic embodiment, the utility knife comprises: a blade-holding portion that comprises a planar bottom wall, a planar channel substantially adjacent to the bottom wall and dimensioned for holding a flat blade in a plane at an angle between 2° and 10° with respect to the bottom wall, and a tip portion adjacent to the bottom wall and having a slot-shaped opening in communication with one end of the planar channel; a toe-in-shoe attachment; and a handle portion offset from the blade-holding portion at an end opposite the tip.

Optional variations of this embodiment include: those further comprising a multi-edged blade secured in the planar channel and extending through the slot-shaped opening in the tip; those further comprising a locating lug in the planar channel and a locating hole in the multi-edged blade; those wherein the multi-edged blade has at least 4 edges; those further comprising a blade carriage means for holding a multi-edged blade and positioning the multi-edged blade at plural locations along the planar channel; those wherein the planar channel is at an angle of about 5° with respect to the bottom wall; those wherein the handle portion comprises a spare blade storage compartment; those wherein the handle portion is offset at a fixed angle from the blade-holding portion; those wherein the handle portion offset and substantially parallel to the blade-holding portion; and those further comprising: a multi-edged blade; and a blade carriage means for holding the multi-edged blade and positioning the multi-edged blade at plural locations along the planar channel, wherein the planar channel is at an angle of about 5° with respect to the bottom wall.

In another embodiment, the utility knife comprises a lower portion, an upper portion, means for fastening the lower and upper portions, and a flat blade held between the upper and lower portions, wherein the lower portion comprises a lower blade-holding portion with a planar bottom wall, a planar channel dimensioned for holding the flat blade in a plane at an angle between 2° and 10° with respect to the bottom wall, and a tip portion having a slot in a lower portion and a toe-in-shoe attachment. Further, a lower handle portion may be offset from the blade-holding portion at an end opposite the tip portion, and the upper portion comprises an upper blade-holding portion with a planar blade-claimping plate dimensioned to fit the planar channel for holding the flat blade, the blade-claimping plate having a tip dimensioned to fit the slot in the lower portion to form the toe-in-shoe attachment and position the blade in a lower portion of the slot, and an upper handle portion offset from the blade-holding portion at an end opposite the tip.

Optional variations of this embodiment include: those wherein the means for fastening the lower and upper portions comprises a fastener between the upper and lower handle portions; those wherein the fastener between the upper and lower handle portions is a screw; those wherein the flat blade comprises at least 4 edges, those wherein the flat blade further comprises at least one locating hole, and one of the channel and the blade-clamping plate include at least one locating pin, lug or stud for engaging the locating hole in a blade; those wherein the upper handle portion and lower handle portion are offset at a fixed, obtuse angle between about 135 degrees to about 150 degrees; those wherein the planar channel is dimensioned for holding the flat blade in a plane at an angle of about 5° with respect to the bottom wall; those wherein the upper and lower handle portions form a spare blade storage compartment; those wherein the upper and lower handle portions are offset at a fixed angle from the upper and lower blade-holding portions; and those wherein the upper and lower handle portions are offset and substantially parallel to the upper and lower blade-holding portions.

A transverse angulated utility knife has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. For example different locating member mechanisms and blade clamping means may be used to retain the multi-edged utility knife blade in the device. Further, any reference to claim elements in the singular, for example, using the articles "a," "an," or "the" is not to be construed as limiting the element to the singular.

What is claimed is:

1. A utility knife comprising:

a multi-edged knife blade having a flat surface that defines a two-dimensional plane in space; and a substantially S-shaped handle for supporting the blade, said handle comprising a substantially S-shaped first member and a substantially S-shaped second member, wherein said first member is removably attached to said second member in order to create said substantially S-shaped handle and wherein said second member comprises a shoe portion and said first member comprises a tip portion configured to slide into said shoe portion and capture the knife blade, wherein one leg of the S-shape is a gripping portion and the other leg of the S-shape is a blade supporting portion, and said gripping portion is angulated in a fixed manner with respect to said blade such that said gripping portion is angulated away from and out of said two-dimensional plane, wherein the blade supporting portion comprises a substantially wedge-shaped channel in said second member adjacent said shoe portion, wherein said substantially wedge-shaped channel comprises a planar bottom surface and the knife blade is supported in a lower, off center position adjacent the planar bottom surface, and wherein the wedge-shaped channel is dimensioned for holding the knife blade at an angle between about 2° and 10° with respect to a bottom wall of the second member.

2. The utility knife of claim 1, wherein the knife blade extends through a slot-shaped opening in a tip of the second member.

3. The utility knife of claim 1, further comprising:

a locating lug on the substantially S-shaped first member; and a locating hole in the blade.

4. The utility knife of claim 1, wherein the multi-edged blade has at least 4 edges.

5. The utility knife of claim 1, wherein the angle the knife blade is held with respect to the bottom wall of the second member is about 5°.

6. The utility knife of claim 1, wherein the gripping portion comprises a spare blade storage compartment.

7. The utility knife of claim 1, wherein the gripping portion is offset at a fixed angle from the blade supporting portion.

8. The utility knife of claim 1, wherein the gripping portion is offset and substantially parallel to the blade supporting portion.

9. The utility knife of claim 1, further comprising:

a blade carriage configured to hold the blade and position the blade at plural locations along the planar channel, wherein the angle knife blade is held with respect to the bottom wall of the second member is about 5°.

10. A utility knife comprising:

a detachable blade having a flat surface that defines a two-dimensional plane in space, the blade having a sharp edge and an anchoring hole; and a substantially S-shaped handle supporting the blade, wherein one leg of the S-shape is a gripping portion and the other leg of the S-shape is a blade supporting portion, and the gripping portion is angulated in a fixed manner with respect to the blade such that the gripping portion is angulated away from and out of the two-dimensional plane, the substantially S-shaped handle comprising:

a substantially S-shaped first member;

a substantially S-shaped second member;

a substantially wedge-shaped channel disposed within the blade supporting portion of the substantially S-shaped second member configured to contain and support the blade, the substantially wedge-shaped channel comprises a planar bottom surface of the blade supporting portion of the substantially S-shaped second member;

a locating pin disposed within the blade supporting portion of the substantially S-shaped handle and configured to engage the anchoring hole in the blade;

a shoe portion configured in the second member adjacent an open end of the substantially wedge-shaped channel; and a tip portion configured on the first member, wherein the tip portion is configured to slide into the shoe portion and capture the blade in a lower, off-center position adjacent the planar bottom surface, thereby removably attaching the first and second members together in order to create said substantially S-shaped handle, and wherein the wedge-shaped channel is dimensioned for holding the knife blade at an angle between about 2° and 10° with respect to a bottom wall of the second member.

11. The utiltiy knife of claim 10, further comprising a fastener between the substantially S-shaped first and second members for fastening the substantially S-shaped first and second members together.

12. The utility knife of claim 11, wherein the fastener between the substantially S-shaped first and second members is a screw.

13. The utility knife of claim 10, wherein the flat blade comprises at least 4 edges.

14. The utility knife of claim 13, wherein the substantially S-shaped first member includes a blade-clamping plate and the blade-clamping plate includes the locating pin.

15. The utility knife of claim 10, wherein the gripping portion and blade supporting portion are offset at a fixed, obtuse angle between about 135 degrees to about 150 degrees.

16. The utility knife of claim 10, wherein the angle the knife is held with respect to the bottom wall of the second member is about 5°.

17. The utility knife of claim 10, wherein the gripping portion comprises a spare blade storage compartment.

18. the utility knife of claim 10, wherein the gripping portion is offset at a fixed angle from the blade supporting portion.

19. The utility knife of claim 10, wherein the gripping portion is offset and substantially parallel to the blade supporting portion.

20. The utility knife of claim 10, further comprising a blade carriage configured to hold the blade and position the blade at plural locations along the channel.

* * * * *